US006217946B1

(12) United States Patent
Bolind et al.

(10) Patent No.: US 6,217,946 B1
(45) Date of Patent: Apr. 17, 2001

(54) METHOD FOR APPLYING POLYMERIC DIPHENYLMETHANE DIISOCYANATE TO CELLULOSE/GYPSUM BASED SUBSTRATE

(75) Inventors: Michael L. Bolind, Ingleside; Michael J. Porter, Hanover Park; Mark B. Scalf, McHenry, all of IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 09/360,873

(22) Filed: Jul. 23, 1999

(51) Int. Cl.[7] ..... B05D 1/28

(52) U.S. Cl. ..... 427/429; 427/385.5; 427/393.6; 15/257.06

(58) Field of Search ..... 427/372.2, 385.5, 427/393.6, 428, 429; 15/257.06

(56) References Cited

U.S. PATENT DOCUMENTS

| | | | | |
|---|---|---|---|---|
| 3,967,016 | | 6/1976 | Schneller et al. . | |
| 4,229,503 | * | 10/1980 | Day | 428/451 |
| 4,382,809 | | 5/1983 | Porter et al. . | |
| 5,323,505 | | 6/1994 | Montabaur et al. . | |
| 5,386,608 | | 2/1995 | Montabaur et al. . | |
| 5,397,631 | * | 3/1995 | Green et al. | 428/219 |
| 5,591,252 | | 1/1997 | Haeuser . | |
| 5,718,785 | * | 2/1998 | Randall | 156/39 |
| 5,718,797 | | 2/1998 | Phillips et al. . | |
| 5,895,690 | * | 4/1999 | Greisel | 427/428 |

OTHER PUBLICATIONS

ICI Polyurethanes, "The Nature of the MDI/Wood Bond" No. WD–516, 7/91, Ten Pages.

Forest Products Society 1994, Forest Prod. J. 44(3):34–40; "Effect of polyisocyanate level on strength properties of wood fiber composite materials" Bernard C.H. Sun, Robert N. Hawke, Margaret R. Gale, Mar. 1994.

* cited by examiner

*Primary Examiner*—Fred J. Parker
*Assistant Examiner*—Jennifer Calcagni
(74) *Attorney, Agent, or Firm*—Lee, Mann, Smith, McWilliams, Sweeney & Ohlson; John M. Lorenzen; David Janci

(57) ABSTRACT

The disclosed invention consists of a means for conveying a gypsum or gypsum/cellulose fiber board to a rotary cylinder brush station where pMDI resin is delivered onto the rotary cylinder brush just as the board passes under the brush. A resin distribution system is used to coat the rotary cylinder brush applicator with pMDI. Optionally, a second rotary cylinder brush station is included, if desired, to smooth out and spread the pMDI resin over the surface of the gypsum board substrate to achieve complete coverage.

6 Claims, 4 Drawing Sheets

METHOD FOR APPLYING POLYMERIC DIPHENYLMETHANE DIISOCYANATE TO CELLULOSE/GYPSUM BASED SUBSTRATE

BACKGROUND OF THE INVENTION

The present invention relates generally to the ability to provide a uniform application of polymeric diphenylmethane diisocyanate (pMDI) onto gypsum boards, cellulose gypsum panels and other surfaces. More particularly, the present invention relates to the use of rotary cylinder brush technology to provide a uniform application of pMDI onto cellulose/gypsum based substrates.

Exterior wall cladding is used as a barrier to keep exterior air and moisture out of the wall cavity. If water and moisture penetrate the wall cladding surface damage will result to the cladding board itself. Prior art exterior wall cladding was made out of gypsum sheathing or water resistant gypsum board. It was found that the application of pMDI to gypsum board greatly increased the board's strength and water resistance; however, early attempts at applying pMDI to cellulose/gypsum based substrate membranes have met with little success. The prior art method of applying the pMDI was to use a spray apparatus which atomized the pMDI so it could be applied to gypsum board. The spray technique has several problems. First, the spraying of the pMDI results in a non-uniform application of the coating which prevents the achieving uniform water resistance across the gypsum board. Second, the atomization of pMDI creates a health concern by introducing small particles of pMDI into the air that can be inhaled by persons in the vicinity. The disclosed invention applies the pMDI with an apparatus that provides a uniform coating across the gypsum board which results in an increase in water resistance.

SUMMARY OF THE INVENTION

The disclosed invention consists of a means for conveying a gypsum board or panel to a rotary cylinder brush station where pMDI resin is delivered onto the rotary cylinder brush just as the panel passes under the brush. A resin distribution system is used to coat the rotary cylinder brush applicator with pMDI. Optionally, to assist in the spreading of the pMDI resin over the surface of the gypsum board to achieve complete coverage of the cellulose/gypsum based substrate, a second rotary cylinder brush can be included. The bristles of the second rotary cylinder brush may be finer than the bristles of the first rotary brush.

DETAILED DESCRIPTION OF THE PREFERRED EMBODIMENTS

The present invention is directed to a method for applying a polymeric solution for achieving water resistance, and preferably applying a resin such as polymeric diphenylmethane diisocyanate (pMDI) to a cellulose/gypsum based substrate, and in particular, the use of one or more rotary cylinder brushes to provide a uniform application of pMDI onto the cellulose/gypsum based substrate.

Figure 1:
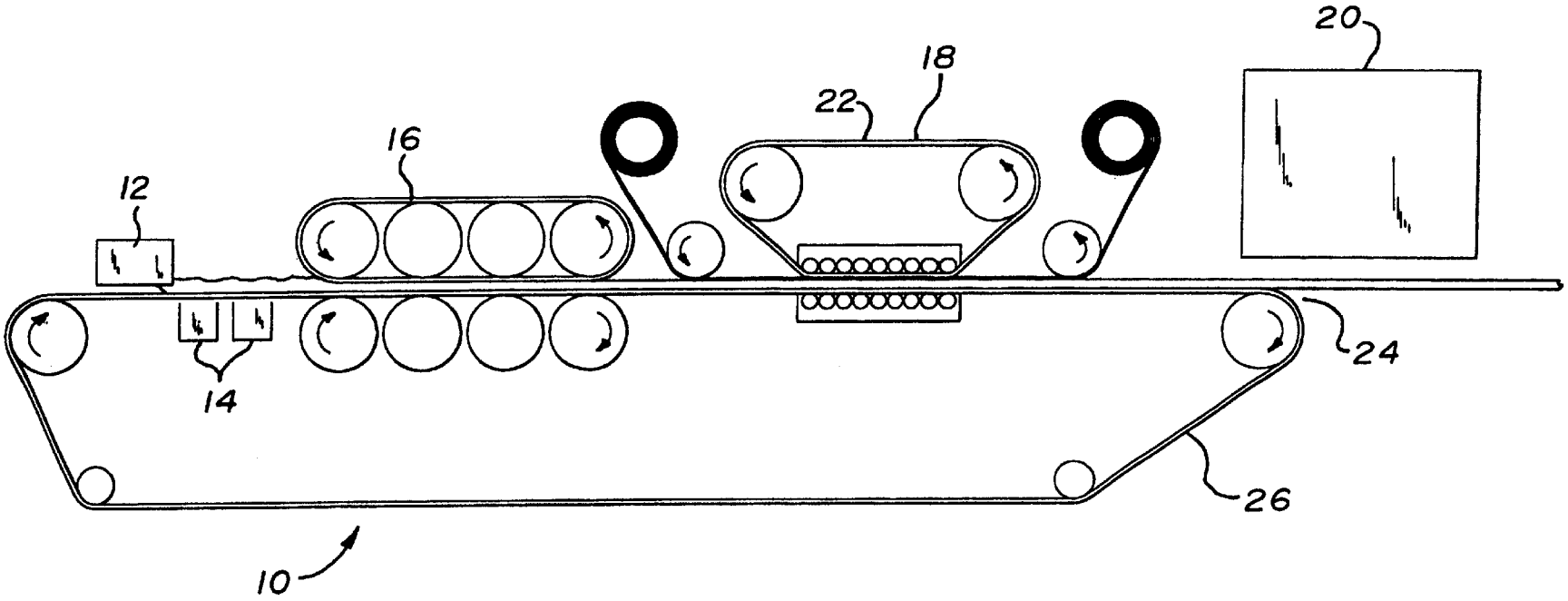
FIG. 1 is a schematic drawing illustrating a production line for forming gypsum fiberboard having a head box, dewatering vacuums, a dewatering primary press, a secondary press, and a drying kiln all for processing a rehydratable gypsum fiber slurry upon a conveyor.

The forming system, generally designated with the numeral 10 and shown in FIG. 1, includes a head box 12, vacuum boxes 14, a wet (primary) press 16, a secondary press 18, and a drying kiln 20. The function of the primary press 16 is 1) to nip a gypsum/cellulose fiber filter cake mat to a desired thickness and 2) to remove 80–90% of remaining water. The function of the secondary press 18 is to compress the board during setting to a calibrated final thickness and to aid in achieving flexural strength in the final product. The secondary press 18 has a continuous belt 22 that also aids in achieving smoothness to the board surface as the rehydrating mat expands against the belt 22. The head box 12 is used to uniformly disperse a calcined slurry having at least about 70% liquid by weight, across the width of the forming table 24, where vacuum boxes 14 are used to dewater the slurry into a mat of generally 28–41% moisture content (wet basis) (40–70% moisture content on a dry basis). The forming table 24 includes side dams to contain the slurry pond and a conveyor or forming wire 26 to move the slurry away from the head box 12 and towards the primary press 16. As the slurry moves along the forming table 24, the vacuum boxes 14 dewater the slurry into a mat, creating a decreasing water content gradient in the slurry going from the head box 12 towards the primary press 16. At some point along this gradient, there is a zone referred to as the wet line, where it is observable that the slurry is changing into the wet mat. Put another way, one can see that the slurry is no longer fluid as the water is removed.

In the preferred embodiment, the slurry pond is further dewatered and formed into a filter cake by the application of additional vacuum boxes 14. With reference to FIG. 1, the conveyor or forming wire 26 carries the filter cake to the primary press 16 which further dewaters the filter cake and nips the material to a desired thickness. During this time, the board begins setting and expands to fill the nip gap. The board exits the primary press 16 and is carried on the conveyor 26 to the secondary press 18. The secondary press 18 shapes the board to a final calibrated thickness. The board expands against the smooth belt 22 of the secondary press 18 which further aids in rendering a smooth surface and increased flex strength.

Figure 2:
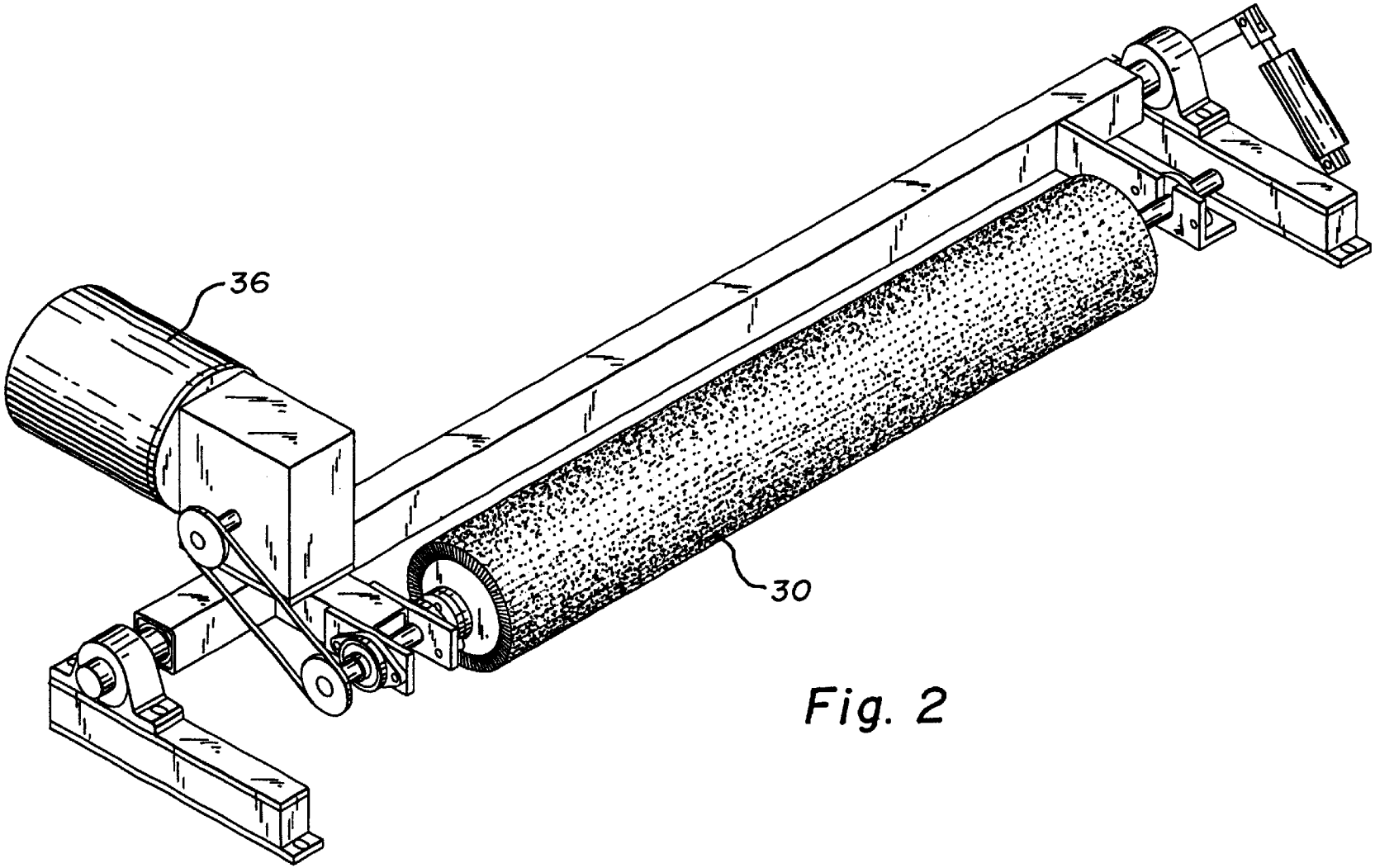
FIG. 2 is a perspective view of the first brush station of the present invention having a gearmotor drive and a rotary applicator brush.
Figure 3:
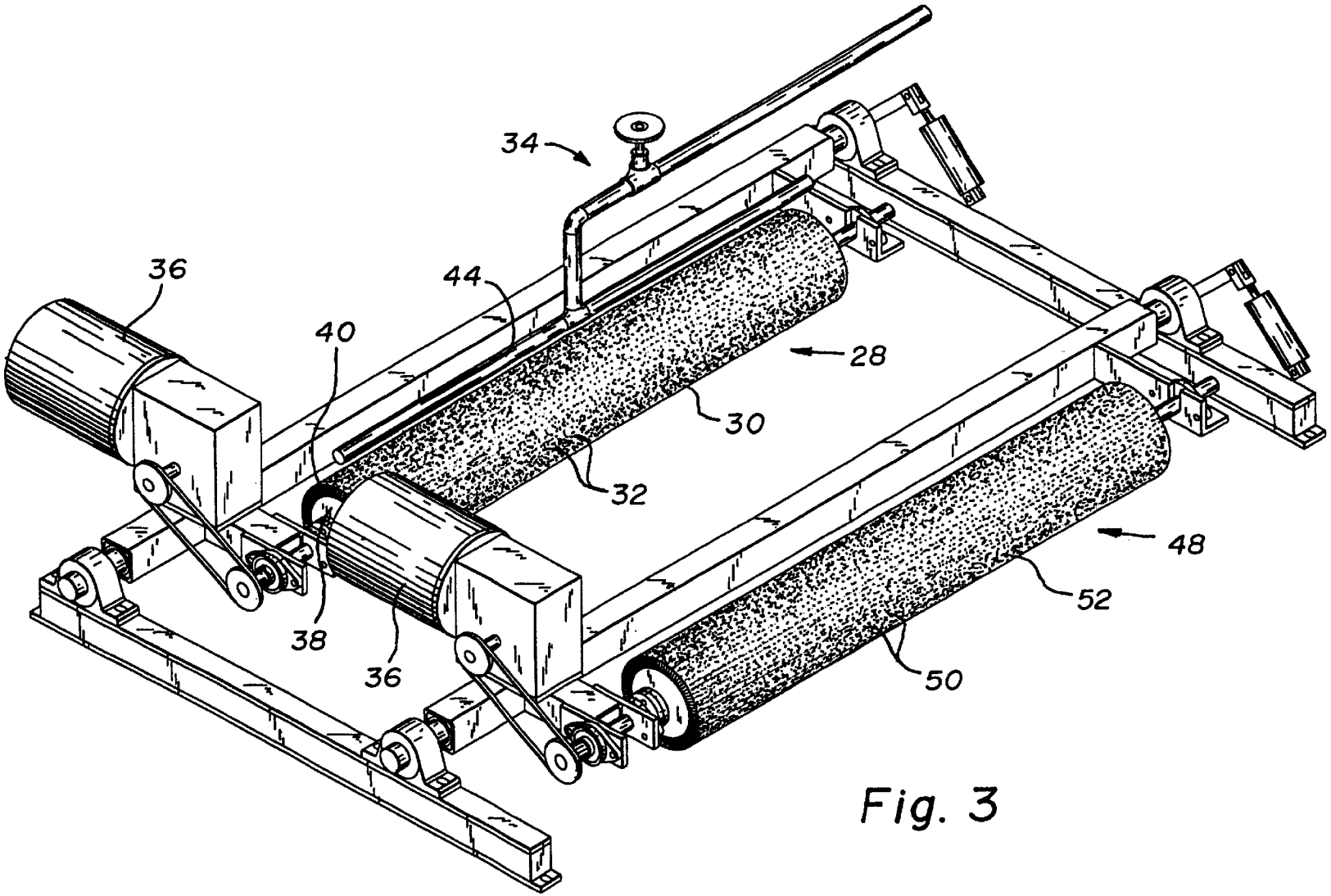
FIG. 3 is a perspective view of the an optional second embodiment of the invention including a first application brush station and a second smoothing brush station, the first station including a gear motor drive, a resin distribution system and a first application brush, the second smoothing station including a gear motor drive and a second smoothing brush.

After exiting the secondary press 18, the board is dried in a kiln 20. After the board is completely dried, the conveyer 26 carries the board to the primary rotary brush station 28, as best seen in FIGS. 2 and 3. Preferably, the primary rotary brush station 28 is comprised of an rotary cylinder brush 30 having bristles 32 and a resin distribution system 34. One suitable brush for use as the brush 30 is made of nylon and manufactured by INDUSCO (Fairfield, N.J.). The function of the resin distribution system 34 is to continuously supply pMDI resin to the rotary cylinder brush 30, as will be explained more fully below. The brush 30 is rotatably driven by a gearmotor 36, such that as the board passes under the brush 30, the bristles 32 of the brush 30 repeatedly come into contact with the board. The resin distribution system 34 continuously coats the bristles 32 of the rotary brush 30 with pMDI resin as the brush 30 rotates. As the bristles 32 coated with pMDI resin come into contact with the board, the pMDI resin is uniformly applied to the surface of the board. The amount of pMDI resin applied can vary, although preferably a range of 9–20 lbs. of pMDI resin is brush-coated per every 1,000 square feet of board.

In the exemplary embodiment, the rotary cylinder brush 30 includes a core 38, an applicator sleeve 40 and bristles 32. The core 38 is approximately fifty-one inches long, has an inner diameter of approximately two inches and an outer diameter of approximately three inches. The applicator sleeve 40 in the disclosed embodiment is approximately fifty inches long with an inner diameter that corresponds to the outer diameter of the core 38, and an outer diameter of approximately six inches. The diameter, however, may vary depending upon the treated board texture, its width, and the application rate. All along the outer circumference of the applicator sleeve 40 are bristles 32, preferably made of nylon. It is preferred that the bristles 32 be somewhere in the range of 0.011 inches to about 0.016 inches in diameter, although it is known that the diameter of the bristles 32 can range anywhere from 0.010 inches to 0.018 inches.

Although core 38 and applicator sleeve 40 are described as being fifty-one inches and fifty inches in length, respectively, it is known that this length can vary depending upon the width of the gypsum panels to be treated.

Figure 4:
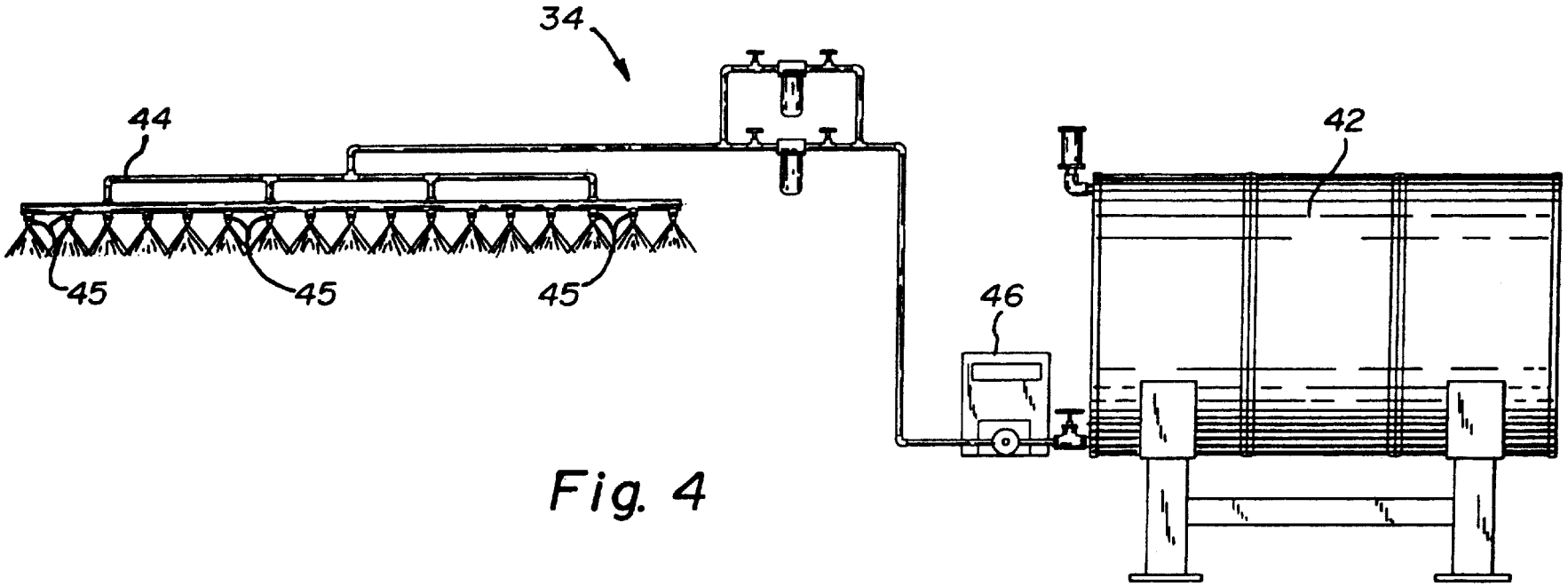
FIG. 4 is a front view of the resin distribution system of FIG. 3, including a resin drum, an application manifold and a metering pump.

The resin distribution system 34, as best seen in FIG. 4, includes a resin drum 42 for storage of the pMDI resin, and an application manifold 44 for spraying the resin onto the bristles 32 of the application brush 30. The pMDI resin is conveyed from the drum 42 to the manifold 44 via a metering pump 46 through series of conduits. The pump 46 controls the amount of resin that is applied to the substrate. The application manifold 44 includes a series of sprayers 45 extending along the length of the application brush 30 to ensure that the bristles 32 of the brush are coated with the resin throughout the length of the brush 32. The sprayers 45 of the exemplary embodiment are about 3 inches on center, but may vary depending upon the application rate. The sprayers 45 comprise nozzles, as shown in the figures, but other spray or non-spray fluid application means may be used to coat the brush 32. For example, a perforated pipe is one alternative.

Optionally, a second (smoothing) rotary cylinder brush station 48 can be included adjacent to the first brush station 28 and subsequent to the first brush station 28 in the coating process, as illustrated in FIG. 3. The structure of the second brush station 48 is similar to the first brush station 28. However, preferably the bristles 50 of the smoothing brush 52 are finer than the bristles 32 of the application brush 30. The smoothing brush 52 is used, if desired, to assist in the spreading and smoothing out of the pMDI resin over the surface of the gypsum and cellulose fiber board to achieve complete coverage of the gypsum board panel.

In a second application (not shown), the disclosed apparatus and method for applying pMDI resin is used to apply pMDI onto a gypsum board with paper, allowing the pMDI to absorb into the panel paper, thereby adding considerable strength to the wallboard when the pMDI is allowed to dry and set within the paper. The resultant gypsum boards with pMDI resin exhibit superior properties when compared to regular gypsum sheathing or water-resistant gypsum boards.

Various features of the invention have been particularly shown and described in connection with the illustrated embodiments of the invention. However, it must be understood that these particular arrangements, and their method of manufacture, do not limit but merely illustrate, and that the invention is to be given its fullest interpretation within the terms of the appended claims.

What is claimed is:

1. A method of applying a non-aqueous polymeric diphenylmethane diisocyanate (pMDI) resin to a gypsum based board having cellulosic fibers at its surface comprising the steps of:

1) providing a dried gypsum based substrate having a cellulosic component;

2) providing a rotary cylinder brush having bristles;

3) continuously distributing the non-aqueous polymeric pMDI resin onto said bristles using a resin distribution system;

4) uniformly applying said polymeric pMDI resin onto said substrate by pressing said bristles against said substrate, thereby transferring the polymeric pMDI resin from said bristles onto said substrate; and 5) allowing said polymeric pMDI resin to absorb into said substrate and to cure within said substrate.

2. A method in accordance with claim 1, wherein said resin distribution system includes a source of the polymeric pMDI resin and an application manifold for spraying said polymeric pMDI resin onto said bristles.

3. A method in accordance with claim 1 further including the step of rotating said brush as said bristles press against said substrate.

4. A method in accordance with claim 3 wherein the step of rotating said brush as said bristles press against said substrate includes the use of a motor.

5. A method of applying a polymeric dithcnylmethane diisocyanate (pMDI) resin to a gypsum fiberboard comprising the steps of:

1) providing a gypsum based substrate;

2) providing a brush having bristles;

3) distributing the polymeric pMDI resin onto said bristles;

4) uniformly applying said polymeric pMDI resin onto said substrate by pressing said bristles against said substrate, thereby transferring the polymeric pMDI resin from said bristles onto said substrate;

5) providing a second brush having bristles, said second bristles pressing against said substrate to further spread the polymeric pMDI resin over said substrate; and 6) allowing said polymeric pMDI resin to absorb into said substrate and to cure.

6. A method in accordance with claim 5 wherein said second bristles are finer than said first bristles.

* * * * *